US005561013A

United States Patent [19]

O'Brien et al.

[11] Patent Number: 5,561,013

[45] Date of Patent: Oct. 1, 1996

[54] MAGENTA TONER AND IMAGING PROCESSES

[75] Inventors: Katherine N. O'Brien, Pittsford; Janet L. Castano, Penfield; Donald Riley, Rochester; Charles D. Zimmer; Mark D. Ballou, both of Webster; Jane M. Kanehl, Bloomfield; Sandra J. Hutkowski, Penfield; Patricia J. Donaldson, Pittsford; Raymond L. Sommers, Fairport, all of N.Y.

[73] Assignee: Xerox Corporation, Stamford, Conn.

[21] Appl. No.: 529,261

[22] Filed: Sep. 15, 1995

[51] Int. Cl.[6] ..... G03G 9/09

[52] U.S. Cl. ..... 430/45; 430/109

[58] Field of Search ..... 430/106, 109, 430/110, 126, 44, 45

[56] References Cited

U.S. PATENT DOCUMENTS

| | | | |
|---|---|---|---|
| 4,057,426 | 11/1977 | Mammino et al. | 430/104 |
| 4,078,929 | 3/1978 | Gundlach | 96/1.2 |
| 4,264,185 | 4/1981 | Ohta | 355/4 |
| 4,378,415 | 3/1983 | Chu | 430/45 |
| 5,370,962 | 12/1994 | Anderson et al. | 430/137 |

*Primary Examiner*—John Goodrow
*Attorney, Agent, or Firm*—E. O. Palazzo

[57] ABSTRACT

An imaging process which comprises (1) charging an imaging member in an imaging apparatus; (2) creating on the member a latent image comprising areas of high, intermediate, and low potential; (3) developing the low areas of potential with a first developer comprising carrier particles and a first negatively charged toner comprised of resin, the magenta pigment 2,9-dimethyl quinacridone, a charge additive, or a mixture of charge additives, and surface additives; (4) developing the high areas of potential with a second developer comprising carrier particles and a second black toner comprised of resin, pigment, and a charge enhancing additive that enables a positively charged toner; (5) transferring the resulting developed image to a substrate; and (6) fixing the image thereto.

15 Claims, No Drawings

MAGENTA TONER AND IMAGING PROCESSES

BACKGROUND OF THE INVENTION

The present invention is directed to toners, developers, and imaging processes, including a process for forming two-color images, and more specifically, the present invention is directed to a process for obtaining two-color images which in embodiments comprises charging an imaging member; creating on the member a latent image comprising areas of high, medium, and low potentials; developing the low areas of potential with a positively charged colored developer composition referred to as discharge area development (DAD); subsequently, developing the high areas of potential with a negatively charged black developer composition referred to as charged area development (CAD), and transferring the developed images to a substrate, and optionally permanently affixing the image to the substrate. The positively charged color developer composition, which in embodiments of the present invention is comprised of a negatively charged magenta toner comprised, for example, of resin and charge additive, or a mixture of charge enhancing additives of, for example, distearyl dimethyl ammonium methyl sulfate (DDAMS) and cetylpyridinium chloride, and surface additives of silica, metal salts of a fatty acid, and an aluminum complex, such as BONTRON E-88®, can be selected for the development of the low areas of potential; thereafter, the high areas of potential can be developed with a negatively charged black developer composition comprised of a positively charged black toner comprised, for example, of a resin, carbon black and a charge enhancing additive, transferring both the color and black developed images to a substrate, and permanently affixing the images to the substrate by, for example, heat or a combination of heat and pressure In one development process embodiment of the present invention, there can be selected the toners and developers as illustrated herein for the methods as illustrated in U.S. Pat. No. 4,078,929, the disclosure of which is totally incorporated herein by reference. In process embodiments of the present invention, the photoresponsive imaging member can be negatively charged, positively charged, or both, and the latent image formed on the surface may be comprised of either a positive or a negative potential, or both. In one embodiment of the present invention, the image comprises three distinct levels of potential, all being of the same polarity. The levels of potential should be well differentiated, such that they are separated by at least 100 volts, and preferably 200 volts, or more. For example, a latent image on an imaging member can comprise areas of potential at −800, −400, and −100 volts. In addition, the levels of potential may comprise ranges of potential. For example, a latent image may comprise a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a layered organic photoreceptor is employed, preferred potential ranges are from about −700 to about −850 volts for the high level of potential, from about −350 to about −500 volts for the intermediate level of potential, and from about −80 to about −180 volts for the low level of potential. These potentials can vary depending, for example, upon the type of imaging member selected, and the like.

One advantage associated with the toners and processes of the present invention is the ability to generate high quality two-color images in a single development pass, particularly as a result of the absence of interaction between the colored, excluding black, and the black developers in embodiments of the present invention Other advantages associated with the present invention include the provision of a triboelectrically stable positive charging colored developer comprised of a negative charging color toner, which enables the generation of high quality images subsequent to development, that is images with substantially no background deposits. Moreover, the toners and developers of the present invention in embodiments can be selected as extended color palettes, reference for example U.S. Pat. No. 5,370,962, the disclosure of which is totally incorporated herein by reference.

Processes for obtaining electrophotographic, including xerographic, and two-colored images are known. In U.S. Pat. No. 4,264,185, the disclosure of which is totally incorporated herein by reference, there is illustrated an apparatus for forming two color images by forming a bipolar electrostatic image of a two-color original document on a photoconductive drum. A first developing unit applies a toner of a first color and polarity to the drum, and a second developing unit applies a toner of a second color and polarity to the drum to form a two color electrostatic image which is transferred and fixed to a copy sheet. A bias voltage of the first polarity is applied to the second developing unit to repel the toner of the first color and prevent degradation of the first color toner image. A bias voltage of the second polarity is applied to the first developing unit to prevent contamination of the first color toner with the second color toner.

In U.S. Pat. No. 4,308,821, the disclosure of which is totally incorporated herein by reference, there is illustrated a method and apparatus for forming two-color images which employs two magnetic brushes.

Further, U.S. Pat. No. 4,378,415, the disclosure of which is totally incorporated herein by reference, illustrates a method of highlight color imaging, which comprises providing a layered organic photoreceptor having a red sensitive layer and a short wavelength sensitive layer, subjecting the imaging member to negative charges, followed by subjecting the imaging member to positive charges, imagewise exposing the member, and developing with a colored developer composition comprising positively charged toner components, negatively charged toner components and carrier particles. In U.S. Pat. No. 4,430,402, there is illustrated a two-component type dry developer for use in dichromatic electrophotography, which comprises two kinds of developers, each of which consists of a toner and a carrier. Dichromatic images are formed by developing both positively and negatively electrified electrostatic latent image successively with toners different in polarity and color from each other, wherein one carrier becomes positively charged by friction with either of the two toners while the other carrier becomes negatively charged by friction with either of the two toners. In addition, U.S. Pat. No. 4,640,883, the disclosure of which is totally incorporated herein by reference, illustrates a method of forming composite or dichromatic images, which comprises forming on an imaging member electrostatic latent images having at least three different potential levels, the first and second latent images being represented, respectively, by a first potential and a second potential relative to a common background potential. The first and second images are developed by a first magnetic brush using two kinds of toners, at least one of which is magnetic, and both of which are chargeable to polarities opposite to each other with application to a developing electrode of a bias voltage capable of depositing the magnetic toner on the background potential area to deposit selectively the two toners on the first and second latent images, and to deposit the magnetic toner on the background potential area, while collecting the deposited magnetic toner at least from the background potential area by second magnetic brush developing means.

The process of charging a photoresponsive imaging member to a single polarity and creating on it an image consisting of at least three different levels of potential of the same polarity is described in U.S. Pat. No. 4,078,929, the disclosure of which is totally incorporated herein by reference. This patent discloses a method of creating two colored images by creating on an imaging surface a charge pattern including an area of first charge as a background area, a second area of greater voltage than the first area, and a third area of lesser voltage than the first area with the second and third areas functioning as image areas. The charge pattern is developed in a first step with positively charged toner particles of a first color and, in a subsequent development step, developed with negatively charged toner particles of a second color. Alternatively, charge patterns may be developed with a dry developer containing toners of two different colors in a single development step. Also of interest with respect to the trilevel process for generating images is U.S. Pat. No. 4,686,163, the disclosure of which is totally incorporated herein by reference.

Developer compositions with charge enhancing additives, which impart a positive charge to the toner resin, are known. Thus, for example, there is described in U.S. Pat. No. 3,893,935 the use of quaternary ammonium salts as charge control agents for electrostatic toner compositions. Also of interest is U.S. Pat. No. 4,221,856, which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens such as iodide, chloride and bromide. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there are illustrated in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014; 4,394,430, and 4,560,635, which illustrates a toner with a distearyl dimethyl ammonium methyl sulfate charge additive.

Illustrated in copending application U.S. Ser. No. 528,927 now U.S. Pat. No. 5,536,680, filed concurrently herewith, the disclosure of which is totally incorporated herein by reference, is an imaging process which comprises (1) charging an imaging member in an imaging apparatus; (2) creating on the member a latent image comprising areas of high, intermediate, and low potential; (3) developing the low areas of potential with a first developer comprising carrier and a first negatively charged toner comprised of resin, the cyan pigment Pigment Blue 15:3, Color Index number 74160:3, CAS Number 147-14-8, a mixture of charge enhancing additives, and surface additives; (4) developing the high areas of potential with a second developer comprising carrier and a second black toner comprised of resin, pigment, and a charge enhancing additive that enables a positively charged toner; (5) transferring the resulting developed image to a substrate; and (6) fixing the image thereto.

SUMMARY OF THE INVENTION

Examples of objects of the present invention with respect to embodiments thereof are as illustrated herein and include:

It is an object of the present invention to provide toners and imaging processes thereof.

It is another object of the present invention to provide imaging processes for obtaining two-color images, and discharge area development images, that is for example wherein the background areas of a positively charged layered imaging member are developed.

It is another object of the present invention to provide certain positively and negatively charged toners and developers.

It is yet another object of the present invention to provide a process for forming two-color images wherein the first developer does not discharge the latent image to be developed by the second developer.

Another object of the present invention is to provide a two-color image formation process wherein the developers are of specified triboelectric charge, charge distribution, and improved conductivity, and exhibit acceptable admix times and excellent developer lifetimes; and wherein improved toner relative humidity sensitivity is obtained, excellent blend compatibility with other colored toner, and low At/GOW slopes of, for example, 1.46.

Still another object of the present invention is to provide a two-color image formation process wherein when two developers are selected they exhibit similar rheological properties sufficient to enable fusing of both toners at the same fuser system temperature set point. The triboelectric characteristics for the two toners are similar enough to enable effective photoreceptor cleaning of residual images in embodiments of the present invention.

Moreover, in another object of the present invention there are provided two-color image formation processes.

In yet another object of the present invention there are provided processes for improving the blend or mix compatibility of colored toners by adding to the surface thereof blend compatibility components, such as charge additives, and which toners possess a number of excellent characteristics, such as a combination of improved flow, conductivity, admix and blend compatibility; and wherein there are provided negatively charge color toners, and positively charged black toners that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference.

Another object of the present invention resides in the formation of toners which will enable the development of images in electrophotographic imaging apparatuses, which images have substantially no background deposits thereon, are substantially smudge proof or smudge resistant, and therefore, are of excellent resolution; and further, such toner compositions can be selected for high speed electrophotographic apparatuses, that is for example those generating from about 50 to about 92 copies per minute, reference the Xerox Corporation 4850 and 4890 color machines.

In another object of the present invention there are provided toners and processes thereof wherein for one developer there is selected a mixture of pigments, at least one of which is SUNFAST MAGENTA™, a 2,9-dimethyl quinacridone with a CI (Color Index) number of 73915, and wherein, for example, the mixture can include the SUNFAST MAGENTA™ pigment and a second, third, or fourth pigment as illustrated herein for example.

These and other objects of the present invention can be accomplished in embodiments thereof by providing imaging processes and toner compositions comprised of resin particles, pigment particles, internal charge enhancing additives dispersed therein and surface additives thereof. The toner of the present invention in embodiments is comprised of resin particles, the magenta pigment SUNFAST MAGENTA™, a 2,9-dimethyl quinacridone, with a CI (Color Index) number of 73915, and a CAS (chemical abstract number) of 980-26-7, a charge additive, and thereover, surface additives of AEROSIL®, metal salts of fatty acids, and an aluminum complex, preferably BONTRON E-88®. Preferably the magenta toner of the present invention is comprised of styrene butadiene resin, 3.5 weight percent of SUNFAST MAGENTA™ pigment, 1.2 weight percent of DDAMS (distearyl dimethyl ammonium methyl sulfate), and on the toner surface 0.3 weight percent of the silicon dioxide, 0.3 weight percent of zinc stearate, and 0.1 weight percent of BONTRON E-88®, or tris(3,5-di-tertiary-butylsalicylato) aluminum.

In embodiments of the present invention there is provided a process for forming two-color images which comprises (1) charging an imaging member in an imaging apparatus; (2) creating on the member a latent image comprising areas of high, intermediate, and low potential; (3) developing the low areas of potential by, for example, conductive magnetic brush development with a developer comprising carrier particles, and a colored first magenta toner comprised of styrene butadiene resin, 3.5 weight percent of SUNFAST MAGENTA™ pigment, 1.2 weight percent of DDAMS (distearyl dimethyl ammonium methyl sulfate), and on the toner surface 0.3 weight percent of AEROSIL R972®, 0.3 weight percent of zinc stearate, and 0.1 weight percent of BONTRON E-88®, tris(3,5-di-tertiary-butylsalicylato) aluminum; (4) subsequently developing the high areas of potential by conductive magnetic brush development with a developer comprising a second developer comprised of carrier particles, and a toner comprised of resin, black pigment, such as carbon black, and a charge enhancing additive; (5) transferring the developed two-color image to a suitable substrate; and (6) fixing the image thereto.

In embodiments of the present invention, the first developer comprises a first magenta toner with resin present in an effective amount of from, for example, about 70 to about 98 percent by weight, which resin can be selected from the group consisting of polyesters, styrene-butadiene polymers, styrene-acrylate polymers, styrene-methacrylate polymers, PLIOLITES®, crosslinked styrene acrylates, crosslinked styrene methacrylates, and the like wherein the crosslinking component is, for example, divinyl benzene, and mixtures thereof; and a second developer comprised of a second positively charged black toner comprised of resin present in an effective amount of from, for example, about 70 to about 98 percent by weight, which resin can be selected from the group consisting of polyesters, styrene-butadiene polymers, styrene-acrylate polymers, styrene-methacrylate polymers, PLIOLITES®, crosslinked styrene acrylates, crosslinked styrene methacrylates, and the like wherein the crosslinking component is, for example, divinyl benzene, and mixtures thereof; and a black pigment present in an effective amount of from, for example, about 1 to about 15 percent by weight, and preferably from about 2 to about 7 weight percent wherein the aforementioned black toner contains a charge enhancing additive, such as an alkyl pyridinium halide, distearyl dimethyl ammonium methyl sulfate, mixtures of charge additives, reference U.S. Pat. No. 4,904,762 and 4,937,157, the disclosures of which are totally incorporated herein by reference, and in an embodiment cetyl pyridinium chloride. In an embodiment, the positively charged black toner is comprised of 94 percent by weight of a styrene n-butyl methacrylate copolymer (58/42), 4 percent by weight of REGAL 330®carbon black, and 2 percent by weight of the charge enhancing additive cetyl pyridinium chloride. The aforementioned toners, especially the magenta toner, include as surface or external components additives in an effective amount, such as colloidal silicas, metal salts, metal salts of fatty acids, reference for example U.S. Pat. Nos. 3,590,000; 3,655,374; 3,900,588 and 3,983,045, the disclosures of which are totally incorporated herein by reference, for the primary purpose of controlling toner conductivity and powder flowability, and the other additives indicated herein.

Embodiments of the present invention include an imaging process, which comprises (1) charging an imaging member in an imaging apparatus; (2) creating on the member a latent image comprising areas of high, intermediate, and low potential; (3) developing the low areas of potential with a first developer comprising carrier particles and a first negatively charged toner comprised of resin, the magenta pigment 2,9-dimethyl quinacridone, a charge additive, or a mixture of charge additives, and surface additives; (4) developing the high areas of potential with a second developer comprising carrier particles and a second black toner comprised of resin, pigment, and a charge enhancing additive that enables a positively charged toner; (5) transferring the resulting developed image to a substrate; and (6) fixing the image thereto; an imaging process consisting essentially of (1) charging an imaging member in an imaging apparatus; (2) creating on the member a latent image comprising areas of high, intermediate, and low potential; (3) developing the low areas of potential with a first developer comprising carrier and a first negatively charged toner comprised of resin, the magenta pigment 2,9-dimethyl quinacridone, a charge additive, or a mixture of charge additives, and surface additives; (4) developing the high areas of potential with a second developer comprising carrier and a second black toner comprised of resin, pigment, and a charge enhancing additive that enables a positively charged toner; (5) transferring the resulting developed image to a substrate; and (6) fixing the image thereto, and wherein said magenta pigment is present in an amount of about 3.5 weight percent, said resin is styrene butadiene, said charge additive for the negatively charge toner is distearyl dimethyl ammonium methylsulfate present in an amount of about 1.2 weight percent, and said surface additives are comprised of about 0.3 weight percent of zinc stearate, 0.3 weight percent of fumed silica, and 0.1 weight percent of the complex salt tris(3,5-di-tertiary-butylsalicylato) aluminum, and wherein the charge additive for the positively charged toner is cetyl pyridinium chloride; a toner comprised of styrene butadiene resin, the magenta pigment 2,9-dimethyl quinacradone, a charge additive, and surface additives; and wherein the magenta pigment is present in an amount of from about 3.0 to about 4.0 weight percent, the charge additive is distearyl dimethyl ammonium methyl sulfate present in an amount of from about 1.0 to 1.4 weight percent, and wherein the surface additives are comprised of a mixture of fumed silica present in an amount of about 0.3 weight percent, zinc stearate present in an amount of from about 0.25 to about 0.35 weight percent, and tris(3,5-di-tertiary-butylsalicylato) aluminum present in an amount of from about 0.05 to about 0.15weight percent; an imaging process which comprises (1) charging an imaging member in an imaging apparatus; (2) creating on the member a latent image comprising areas of high, intermediate, and low potentials; (3) developing the low areas of potential with a first developer comprising carrier and a first negatively charged toner comprised of resin, a mixture of pigments wherein at least one pigment is the magenta pigment 2,9-dimethyl quinacridone, a charge additive, or a mixture of charge additives, and surface additives; (4) developing the high areas of potential with a second developer comprising carrier and a second black toner comprised of resin, pigment, and a charge enhancing additive that enables a positively charged toner; (5) transferring the resulting developed image to a substrate; and (6) fixing the image thereto; or wherein the fatty acid salt is zinc stearate, and the complex salt is tris(3,5-di-tertiary-butylsalicylato) aluminum; the magenta toner contains styrene butadiene resin, the magenta pigment is present in an amount of from about 3 to about 4 weight percent, the charge additive of distearyl dimethyl ammonium methyl sulfate is present in an amount of from about 1 to about 2 weight percent, and the surface additives are comprised of a mixture of zinc stearate present in an amount of from about 0.1 to about 0.5 weight percent, fumed silica present in an amount of from about 0.1 to about 0.5 weight percent, and tris(3,5-di-tertiary-butylsalicylato) aluminum present in an amount of from about 0.05 to about 0.2 weight percent; wherein the toner for the first developer with magenta pigment possesses a triboelectric charge of from about −5 to about −25 microcoulombs per gram, and the toner for the second developer with black pigment possesses a triboelectric charge of from about +5 to about +25 microcoulombs per gram; wherein the high areas of potential are from about −750 to about −850 volts, the intermediate areas of potential are from about −350 to about −475 volts, and the low areas of potential are from about −95 to about −180 volts, or wherein the high areas of potential are from about −700 to about −850 volts, the intermediate areas of potential are from about −350 to about −500 volts, and the low areas of potential are from about −80 to about −180 volts; wherein the areas, or levels of potential are separated by from about 100 to about 350 volts; wherein the first and second carrier particles possess a conductivity of from about $10^{-14}$ to about $10^{-7}$ (ohm-cm)$^{-1}$; wherein the magenta toner is contained in a housing biased to from about −450 to about −550 volts, and the black developer is contained in a housing biased to from about −250 to about −350 volts, and wherein the transferred image is permanently affixed to the substrate by the application of heat and pressure; or wherein the carrier particles for the first and second developer have an average diameter of from about 50 to about 150 microns.

The carrier for the colored developer in an embodiment of the present invention can be comprised of a steel core with an average diameter of from about 25 to about 225 microns, and a coating thereover selected from the group consisting of methyl terpolymers, polymethyl methacrylate, and a blend of from about 35 to about 65 percent by weight of polymethylmethacrylate and from about 35 to about 65 percent by weight of chlorotrifluoroethylene-vinyl chloride copolymer wherein the coating contains from 0 to about 40 percent by weight of the coating conductive particles, such as carbon black, and wherein the coating weight is from about 0.2 to about 3 percent by weight of the carrier. The carrier for the second black developer can be comprised of a steel core with an average diameter of from about 25 to about 225 microns, and a coating thereover selected from the group consisting of chlorotrifluoroethylene-vinyl chloride copolymer containing from 0 to about 40 percent by weight of conductive particles, and wherein the coating weight is from about 0.4 to about 1.5 percent by weight of the carrier; polyvinylfluoride at a coating weight of from about 0.01 to about 0.2 percent by weight of the carrier; and polyvinylchloride at a coating weight of from about 0.01 to about 0.2 percent by weight of the carrier. Other effective carriers may be selected including carriers comprised of a core and a polymer mixture thereover, such as PMMA and KYNAR®, reference U.S. Pat. Nos. 4,937,166, and 4,935,326, the disclosures of which are totally incorporated herein by reference. The aforementioned carriers usually contain dispersed in the coating a conductive component, such as carbon black, present in an amount of from about 5 to about 40, and preferably from about 20 to about 30 weight percent.

Examples of imaging members selected for the processes of the present invention may be of any type capable of maintaining three distinct levels of potential. Generally, various dielectric or photoconductive insulating members suitable for use in xerographic, ionographic, or other electrophotographic processes may be used, such as amorphous silicon, layered organic photoconductive members as disclosed in U.S. Pat. No. 4,265,990, the disclosure of which is totally incorporated herein by reference, and the like.

The photoresponsive imaging member can be negatively charged, positively charged, or both, and the latent image formed on the surface may consist of either a positive or a negative potential, or both. In one embodiment, the image comprises three distinct levels of potential, all being of the same polarity The levels of potential should be well differentiated, such that they are separated by at least 100 volts, and preferably 200 volts or more. For example, a latent image on an imaging member can consist of areas of potential at −800, −400, and −100 volts. In addition, the levels of potential may consist of ranges of potential. For example, a latent image may consist of a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a layered organic photoreceptor is employed, preferred potential ranges are from about −700 to about −850 volts for the high level of potential, from about −350 to about −500 volts for the intermediate level of potential, and from about −80 to about −180 volts for the low level of potential. These values will differ depending upon the type of imaging member selected. The low levels of potential are developed with the magenta toner illustrated herein, and the high levels of potential are developed with the black toner illustrated herein.

The latent image comprising three levels of potential, hereinafter referred to as a trilevel image, may be formed on the imaging member by any of various suitable methods, such as those illustrated in U.S. Pat. No. 4,078,929, the disclosure of which is totally incorporated herein by reference. For example, a trilevel charge pattern may be formed on the imaging member by the xerographic method of first uniformly charging the imaging member in the dark to a single polarity, followed by exposing the member to an original having areas both lighter and darker than the background area, such as a piece of gray paper having both white and black images thereon. In one preferred embodiment, a trilevel charge pattern may be formed by means of a raster output scanner, optically modulating laser light as it scans a uniformly charged photoconductive imaging member. In this embodiment, the areas of high potential are formed by turning the light source off, the areas of intermediate potential are formed by exposing the imaging member to the light source at partial power, and the areas of low potential are formed by exposing the imaging member to the light source at full power. Other electrophotographic and ionographic methods, or apparatuses of generating latent images are also acceptable.

Generally, in the process of the present invention the highlighted areas of the image are developed with a developer comprised of a negatively charged toner having a color other than black, and preferably magenta, while the remaining portions of the image are developed with the black developer illustrated herein. In general, the highlighted color portions are developed first to minimize the interaction between the two developers, thereby maintaining the high quality of the black image.

Development is generally accomplished by the magnetic brush development process disclosed, for example, in U.S. Pat. No. 2,874,063, the disclosure of which is totally incorporated herein by reference. This method entails the carrying of a developer material containing toner and magnetic carrier particles by a magnet. The magnetic field of the magnet causes alignment of the magnetic carriers in a brushlike configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. For the process of the present invention, the conductive magnetic brush process is generally preferred wherein the developer comprises conductive carrier particles and is capable of conducting an electric field between the biased magnet through the carrier particles to the photoreceptor. Conductive magnetic brush development is generally employed for the process of the present invention in view of the relatively small development potentials of around 200 volts that are generally available for the process; conductive development ensures that sufficient toner is presented on the photoreceptor under these development potentials to result in acceptable image density. Conductive development is also preferred to ensure that fringe fields occurring around the edges of images of one color are not developed by the toner of the other color.

During the development process, the developer housings are biased to a voltage as indicated herein and, for example, between the level of potential being developed and the intermediate level of charge on the imaging member. For example, if the latent image comprises a high level of potential of about −800 volts, an intermediate level of potential of about −400 volts, and a low level of about −100 volts, the developer housing containing the positively charged toner that develops the high areas of potential may be biased to about −500 volts, and the developer housing containing the negatively charged colored toner that develops the low areas of potential may be biased to about −300 volts. These biases result in a development potential of about −180 to −250 volts for the high areas of potential, which will be developed with a positively charged toner, and a development potential of about +180 to +250 volts for the low areas of potential, which will be developed with a negatively charged colored, such as magenta, toner. Background deposits are suppressed by keeping the background intermediate voltage between the bias on the color developer housing and the bias on the black developer housing. Generally, it is preferred to bias the housing containing the positive charged toner to a voltage of from about 100 to about 150 volts above the intermediate level of potential, and to bias the housing containing the positively charged toner to a voltage of from about 100 to about 180 volts below the intermediate level of potential, although these values may be outside these ranges.

The developed image is then transferred to any suitable substrate, such as paper, transparency material, and the like. Prior to transfer, it is preferred to apply a charge by means of a corotron to the developed image in order to charge both toners to the same polarity, thus enhancing transfer. Transfer may be by any suitable means, such as by charging the back of the substrate with a corotron to a polarity opposite to the polarity of the toner. The transferred image is then permanently affixed to the substrate by any suitable means. For the toners of the present invention, fusing by application of heat and pressure is preferred.

Developer compositions suitable for the process of the present invention comprise a toner and a carrier. In one embodiment, the carriers are generally conductive for a conductive magnetite brush (cmb) development system, and exhibit in an embodiment of the present invention a conductivity of, for example, from about $10^{-14}$ to about $10^{-6}$, and preferably from about $10^{-11}$ to about $10^{-7}$ $(\text{ohm-cm})^{-1}$ as determined by a test cell with electrical wires connected to a power source. Conductivity can be generally controlled by the choice of carrier core and coating, and by partially coating the carrier core, or by coating the core with a coating containing carbon black the carrier is rendered conductive. In addition, irregularly shaped carrier particle surfaces and toner concentrations of from about 0.2 to about 6 will generally render a developer conductive. Addition of a surface additive, such as zinc stearate, in an amount from 0.01 to 0.5 percent in one embodiment to the surface of the toner, or carrier particles also renders a developer conductive with the level of conductivity rising with increased concentrations of the additive. Other carriers, including those with conductivities not specifically mentioned, may also be selected, including the carriers as illustrated in U.S. Pat. No. 4,883,736, the disclosure of which is totally incorporated herein by reference, and the U.S. Pat. No. 4,935,326 and 4,937,166, (KYNAR®/PMMA) the disclosures of which are totally incorporated herein by reference. The aforementioned carriers in embodiments comprise a core with two polymer coatings not in close proximity in the triboelectric series.

More specifically, the carrier for the developers of the present invention in embodiments generally comprises ferrite, iron or a steel core, preferably unoxidized, such as Hoeganaes Anchor Steel Grit, with an average diameter of from about 25 to about 215 microns, and preferably from about 50 to about 150 microns. These carrier cores are coated with a solution coating of methyl terpolymer, reference for example U.S. Pat. Nos. 3,467,634 and 3,526,533, the disclosure of which is totally incorporated herein by reference, containing from 0 to about 40 percent by weight of conductive particles such as carbon black or other conductive particles as disclosed in U.S. Pat. No. 3,533,835, the disclosure of which is totally incorporated herein by reference, homogeneously dispersed in the coating material with the coating weight being from about 0.2 to about 3 percent by weight of the carrier, and preferably from about 0.4 to about 1.5 percent by weight of the carrier. Also, the carrier coating may comprise polymethylmethacrylate containing conductive particles in an amount of from 0 to about 40 percent by weight of the polymethylmethacrylate, and preferably from about 10 to about 20 percent by weight of the polymethylmethacrylate, wherein the coating weight is from about 0.2 to about 3 percent by weight of the carrier and preferably about 1 percent by weight of the carrier. Another carrier coating for the carrier of the colored developer comprises a blend of from about 35 to about 65 percent by weight of polymethylmethacrylate and from about 35 to about 65 percent by weight of chlorotrifluoroethylene-vinyl chloride copolymer, commercially available as OXY 461® from Occidental Petroleum Company, and containing conductive particles in an amount of from 0 to about 40 percent by weight, and preferably from about 20 to about 30 percent by weight, wherein the coating weight is from about 0.2 to about 3 percent by weight of the carrier, and preferably about 1 percent by weight of the carrier. Preferably, the carrier coatings are placed on the carrier cores by a solution coating process.

Embodiments of the present invention include an imaging process, which comprises utilizing stable At developers, toners with excellent blend compatibility, improved RH insensitivity, and developers with stable conductivity by (1) charging an imaging member in an imaging apparatus; (2) creating on the member a latent image comprising areas of high, intermediate, and low potential; (3) developing the low areas of potential with a first developer comprising carrier and a first negatively charged toner comprised of resin, the magenta pigment 2,9-dimethyl quinacridone, a charge additive, or a mixture of charge additives, and surface additives; (4) developing the high areas of potential with a second developer comprising carrier and a second black toner comprised of resin, pigment, and a charge enhancing additive that enables a positively charged toner; (5) transferring the resulting developed image to a substrate; and (6) fixing the image thereto; and wherein the magenta pigment is the SUNFAST MAGENTA™ pigment 2,9-dimethyl quinacridone with a CI number of 73915 and a CAS number of 980-26-7; wherein the surface additives are comprised of fumed silica, metal salts of a fatty acid, and an aluminum complex salt, wherein the fatty acid is zinc stearate, and the complex salt is tris(3,5-di-tertiary-butylsalicylato) aluminum; wherein magenta toner contains styrene butadiene resin, the magenta pigment is in an amount of from about 3 to about 4 weight percent, charge additive of distearyl dimethylammonium methyl sulfate is present in an amount of from about 1 to about 2 weight percent, and the surface additives are comprised of a mixture of zinc stearate present in an amount of from about 0.1 to about 0.5 weight percent, fumed silica present in an amount of from about 0.1 to about 0.5 weight percent, and tris(3,5-di-tertiary-butylsalicylato) aluminum present in an amount of from about 0.05 to about 0.2 weight percent; wherein the zinc stearate and silica are present in an amount of 0.3 weight percent, the aluminum compound is present in an amount of about 0.1 weight percent; wherein the toner for the first developer with magenta pigment possesses a triboelectric charge of from about −5 to about −25 microcoulombs per gram, and the toner for the second developer with black pigment possesses a triboelectric charge of from about +5 to about +25 microcoulombs per gram; wherein the high level of potential is from about −750 to about −850 volts, the intermediate level of potential is from about −350 to about −475 volts, and the low level of potential is from about −95 to about −180 volts; wherein the levels of potential are separated by from about 100 to about 350 volts; wherein the first and second carrier possess a conductivity of from about $10^{31\ 14}$ to about $10^{31\ 7}$ (ohm-cm)$^{-1}$; wherein the magenta toner is contained in a housing biased to from about −450 to about −550 volts, and the black developer is contained in a housing biased to from about −250 to about −350 volts; a toner comprised of styrene butadiene resin, the magenta pigment 2,9-dimethyl quinacradone, a charge additive, and surface additives; and wherein the magenta pigment is present in an amount of from about 3.0 to about 4.0 weight percent, the charge additive is distearyl dimethyl ammonium methyl sulfate present in an amount of from about 1.0 to 1.4 weight percent; and wherein the surface additives are comprised of a mixture of fumed silica present in an amount of about 0.3 weight percent, zinc stearate present in an amount of from about 0.25 to about 0.35 weight percent, and tris(3,5-di-tertiary-butylsalicylato) aluminum present in an amount of from about 0.05 to about 0.15 weight percent; and more specifically, wherein the magenta pigment is SUNFAST MAGENTA™ the 2,9-dimethyl quinacridone with a CI number of 73915, and a CAS number of 980-26-7; and a process wherein for layered imaging members with a photogenerating layer and a charge transport layer the high level of potential is from about −700 to about −850 volts, the intermediate level of potential is from about −350 to about −500 volts, and the low level of potential is from about −80 to about −180 volts.

Typical toner resins include styrene acrylates, styrene methacrylates, polyesters, PLIOLITES®, PLIOTONES® available from Goodyear Chemical Company, styrene-butadiene polymers, particularly styrene-butadiene copolymers wherein the styrene portion is present in an amount of from about 83 to about 93 percent by weight, and preferably about 88 percent by weight, and the butadiene portion is present in an amount of from about 7 to about 17 percent by weight, and preferably about 12 percent by weight, such as resins commercially available as PLIOLITE® or PLIOTONE® from Goodyear. Also suitable are styrene-n-butylmethacrylate polymers, particularly those styrene-n-butylmethacrylate copolymers wherein the styrene segment is present in an amount of from about 50 to about 70 percent by weight, preferably about 58 percent by weight, and the n-butylmethacrylate portion is present in an amount of from about 30 to about 50 percent by weight, preferably about 42 percent by weight. Mixtures of these resins are also suitable. Furthermore, particularly suitable are styrene-n-butylmethacrylate polymers wherein the styrene portion is present in an amount of from about 50 to about 80 percent by weight, and preferably about 65 percent by weight, and the nobutylmethacrylate portion is present in an amount of from about 50 to about 20 percent by weight, and preferably about 35 percent by weight. The resin is generally present in an amount of from about 80 to about 98.8 percent by weight.

The aforementioned magenta toner possesses a negative triboelectric charge as determined by the known Faraday Cage method, which charge is, for example, from about −5 to about-40 microcoulombs per gram and preferably from about −10 to about −25 microcoulombs per gram, and an admix time of from about 15 to about 60 seconds and preferably from about 15 to about 30 seconds as determined in the known charge spectrograph.

For the developers, especially the black developers, comprised of a positively charged toner with a pigment, such as carbon black, which developers can be comprised of similar components as the aforementioned colored developers, with the exceptions that a black instead of colored pigment is selected, and the charge enhancing additive is, for example, an alkyl pyridinium chloride, and preferably cetyl pyridinium chloride, which is present in an effective amount of, for example, from about 0.1 to about 10 weight percent, and preferably from about 1 to about 5 weight percent, are usually selected for the development of the high potentials. Examples of black developers suitable for the process of the present invention comprise a toner and a carrier. The carrier comprises in an embodiment of the present invention ferrite, steel or a steel core, such as Hoeganaes Anchor Steel Grit, with an average diameter of from about 25 to about 215 microns, and preferably from about 50 to about 150 microns with a coating of chlorotrifluoroethylene-vinyl chloride copolymer, commercially available as OXY 461® from Occidental Petroleum Company, which coating contains from 0 to about 40 percent by weight of conductive particles homogeneously dispersed in the coating at a coating weight of from about 0.4 to about 1.5 percent by weight. This coating is generally solution coated onto the carrier core from a suitable solvent, such as methyl ethyl ketone or toluene. Alternatively, the carrier coating may comprise a coating of polyvinyl fluoride, commercially available as TEDLAR® from E. I. Du Pont de Nemours and Company, present in a coating weight of from about 0.01 to about 0.2, and preferably about 0.05 percent by weight of the carrier. The polyvinyl fluoride (TEDLAR®) coating is generally coated onto the core by a powder coating process wherein the carrier core is coated with the polyvinyl fluoride in powder form and subsequently heated to fuse the coating. In one preferred embodiment, the carrier comprises an unoxidized steel core, which is blended with polyvinyl fluoride (TEDLAR®), wherein the polyvinyl fluoride is present in an amount of about 0.05 percent by weight of the core. This mixture is then heat treated in a kiln at about 400° F. to fuse the polyvinyl fluoride coating to the core. The resulting carrier exhibits a conductivity of about $7.6\times10^{31\ 10}$ (ohm-cm)$^{-1}$. Optionally, an additional coating of polyvinylidene fluoride, commercially available as KYNAR® from Pennwalt Corporation, may be powder coated on top of the first coating of the carrier in the black developer at a coating weight of from about 0.01 to about 0.2 percent by weight. The carrier for the black developer generally has a conductivity of from about $10^{-14}$ to about $10^{-7}$, and preferably from about $10^{-12}$ to about $10^{31\ 8}$ (ohm-cm)$^{-1}$. Other carriers may be selected including those of the aforementioned copending applications, and/or with conductivities outside the ranges mentioned in an embodiment of the present invention. Developer compositions selected for the processes of the present invention generally comprise various effective amounts of carrier and toner. Generally, from about 0.5 to about 6 percent by weight of toner and from about 94 to about 99.5 percent by weight of carrier are admixed to formulate the developer. The ratio of toner to carrier may vary, however, provided that many of the objectives of the present invention are achieved. For example, an imaging apparatus employed for the process of the present invention may be replenished with a colored developer comprising about 75 percent by weight of toner and about 25 percent by weight of carrier, 60 weight percent of toner and 40 weight percent of carrier, or more generally, from about 85 to about 15 percent toner and from about 15 to 85 percent carrier. The triboelectric charge of the colored toners generally is from about −10 to about −30, and preferably from about −15 to about −20 microcoulombs per gram, although the value may be outside of this range. Particle size of the colored toners is generally from about 7 to about 20 microns in volume average diameter, and preferably about 12 microns in volume average diameter, although the value may be outside of this range.

Examples of toner resins for the positive (positively charged) toner include polyesters, styrene-butadiene polymers, styrene acrylate polymers, and styrene-methacrylate polymers, and particularly styrene-n-butylmethacrylate copolymers wherein the styrene portion is present in an effective amount of, for example, from about 50 to about 65 percent by weight, preferably about 65 percent by weight, and the n-butylmethacrylate portion is present in an amount of from about 20 to about 50 percent by weight, preferably about 42 percent by weight. Generally, the resin is present in an amount of from about 80 to about 98.8 percent by weight, and preferably in an amount of 92 percent by weight. Suitable pigments include those, such as carbon black, including REGAL 330®, commercially available from Cabot Corporation, nigrosine, and the like, reference for example U.S. Pat. No. 4,883,376, the disclosure of which is totally incorporated herein by reference. Generally, the pigment is present in an amount of from about 1 to about 15 percent by weight, and preferably in an amount of about 4 percent by weight.

With respect to the positively charged toner containing, for example, a black pigment, such as carbon black, magnetite or mixtures thereof, there are selected as the charge enhancing additive alkyl pyridinium halides, and preferably cetyl pyridinium chloride, reference U.S. Pat. No. 4,298,672, the disclosure of which is totally incorporated herein by reference, organic sulfates and sulfonates, reference U.S. Pat. No. 4,338,390, the disclosure of which is totally incorporated herein by reference, distearyl dimethyl ammonium methyl sulfate (DDAMS), reference U.S. Pat. No. 4,560,635, the disclosure of which is totally incorporated herein by reference, quaternary ammonium bisulfates, mixtures thereof, and the like. This toner usually possesses a positive charge of from about 10 to about 45 microcoulombs per gram and preferably from about a positive 15 to about 25 microcoulombs per gram, which charge is dependent on a number of known factors as is the situation with the color developer including the amount of charge enhancing additive present and the exact composition of the other compositions, such as the toner resin, the pigment, the carrier core, and the coating selected for the carrier core, and an admix time of from about 15 to about 60 seconds and preferably from about 15 to about 30 seconds. These additives are present in various effective amounts of, for example, from about 0.1 to about 20 weight percent and preferably from about 1 to about 10 weight percent. In the preparation of the invention, the magenta and black toner compositions are subjected to micronization and classification, which classification is primarily for the purpose of removing undesirable fines with a size diameter of 5 microns or less, and substantially very large particles to enable, for example, toner particles with an average volume diameter of from about 5 to about 25 microns and preferably from about 8 to about 20 microns.

The black positively charged toners of the present invention may also optionally contain as an external additive a linear polymeric alcohol comprising a fully saturated hydrocarbon backbone with at least about 80 percent of the polymeric chains terminated at one chain end with a hydroxyl group. The linear polymeric alcohol is of the general formula $CH_3(CH_2)_nCH_2OH$, wherein n is a number of from about 30 to about 300, and preferably from about 30 to about 50, reference for example U.S. Pat. No. 4,883,736, the disclosure of which is totally incorporated herein by reference. Linear polymeric alcohols of this type are generally available from Petrolite Chemical Company as UNILIN™. The linear polymeric alcohol is generally present in an amount of from about 0.1 to about 1 percent by weight of the toner.

The magenta toner can be blended with a green toner to provide a gray, mauve, or loden green toner; with a cyan toner to provide a royal toner (60 weight percent of cyan toner and 40 weight percent of magenta toner), a violet toner (70 weight percent magenta of toner and 30 weight percent of cyan toner); with a red to provide a cardinal toner (65 weight percent of red toner and 35 weight percent of magenta toner), or a ruby toner (65 weight percent of magenta toner and 35 weight percent of red toner); and with a blue toner (50 weight percent of blue toner and 50 weight percent of magenta toner) to provide a purple colored toner. A number of different colored toners can be obtained including, for example, by mixing or blending from about 90 to about 10 weight percent of the magenta toner with from about 10 to about 90 weight percent of the cyan, blue, red or green toners. Blends of three or more toners are also feasible and will expand the color selection further.

Specific embodiments of the invention will now be described in detail. These Examples are intended to be illustrative, and the invention is not limited to the materials, conditions, or process parameters set forth in these embodiments. All parts and percentages are by weight unless otherwise indicated.

EXAMPLE I

A black developer composition was prepared as follows: 93.9 parts by weight of a styrene-n-butylmethacrylate resin, 4.3 parts by weight of REGAL 330® carbon black obtained from Cabot Corporation and 1.8 parts by weight of the charge additive cetyl pyridinum chloride obtained from Hexel Corporation are extruded, followed by micronization using an AFG grinder, which employs conventional air micronization, and air classification using conventional particle size separation technology to yield toner particles of a size of 9 to 13 microns in volume average diameter as determined by the Coulter Counter method. Subsequently, carrier particles were prepared by powder coating a steel core with a particle diameter range of from about 50 to about 150 microns, available from Hoeganaes, with 0.05 parts by weight of TEDLAR® commercially available as TEDLAR® from E. I. Du Pont de Nemours and Company. A black developer was then prepared by blending 96.0 parts by weight of the above prepared coated carrier particles with 4 parts by weight of the above prepared toner in a Lodige blender for about 20 minutes resulting in a developer with a toner exhibiting a triboelectric charge of 18 microcoulombs per gram as determined in the known Faraday Cage apparatus, and a carrier conductivity as determined by a cell test method as indicated herein of $10^{31\ 8}$ (ohm-cm)$^{-1}$ Admix time for substantially uncharged added toner comprised of the same components as the above prepared toner was less than 30 seconds as determined in the known spectrograph.

EXAMPLE II

A magenta developer composition was prepared as follows: 95.3 percent by weight of styrene butadiene, 3.5 percent of the pigment, SUNFAST MAGENTA™, and 1.2 percent by weight of DDAMS as a charge control agent to the toner were melt blended in an extruder, ZSK-53, wherein the die was maintained at a temperature of between 130° and 145° C., and the barrel temperature ranged from about 80° to about 100° C., followed by micronization in an AFG mill and air classification to yield toner particles of a size of 12.5 microns in volume average diameter. The toner particles were then blended with 0.3 percent by weight of AEROSIL R972®, 0.3 percent by weight of zinc stearate and 0.1 percent by weight of BONTRON E-88® onto the surface of the toner in a Lodige blender. Subsequently, carrier particles were prepared by solution coating a Hoeganoes anchor steel core with a particle diameter range of from about 75 to about 150 microns, available from Hoeganaes Company, with 1 part by weight of a coating comprising 20 parts by weight of VULCAN™ carbon black, available from Cabot Corporation, homogeneously dispersed in 80 parts by weight of polymethylmethacrylate, which coating was solution coated from a MEK (methyl ethyl ketone) solvent. The resulting magenta developer was then prepared by blending 96.9 parts by weight of the prepared coated carrier particles with 3.1 parts by weight of the prepared magenta toner in a Lodige blender for about 20 minutes resulting in a developer with a toner exhibiting a triboelectric charge of 19 microcoulombs per gram as determined in the known Faraday Cage apparatus, and a carrier conductivity measured by a cell method as indicated herein of $6\times10^{-10}$ (ohm-cm)$^{-1}$. Admix time for substantially uncharged added fresh new toner comprised of the same components of the above prepared toner was less than 30 seconds as determined in the known charge spectrograph.

The above magenta developer and the black developer were then incorporated into separate housings in an imaging device equipped to generate and develop trilevel images according to the method of U.S. Pat. No. 4,078,929, the disclosure of which is totally incorporated herein by reference. A trilevel latent image was formed on the layered photoconductive imaging member and the low areas of −100 volts potential were developed with the magenta developer, followed by development of the high areas of −750 volts potential with the black developer, subsequent transfer of the two-color image to paper, and heat fusing of the image to the paper. Images formed exhibited excellent copy quality with substantially no background for 400,000 imaging cycles. Also, the aforementioned toners exhibited stable triboelectric charging characteristics, that is the triboelectric charging properties remain relatively constant for 400,000 imaging cycles in a trilevel xerographic imaging test fixture operating in an environmental chamber at relative humidities of from 20 to about 80 percent, and at temperatures of from about 25° C. to about 70° C. at which time the test was terminated.

Other colored and black toner and developers were prepared by repeating the procedures of Examples I and II with substantially similar results when these toners were selected for the generation and developer of trilevel images according to the method of U.S. Pat. No. 4,078,829, the disclosure of which has been totally incorporated herein by reference. Thus, for example, a magenta toner was prepared by melt mixing in a Banbury apparatus 95.3 weight percent of a styrene butadiene copolymer, 91 percent by weight of styrene and 9 percent by weight of butadiene; 3.5 by weight percent of SUNFAST MAGENTA™ and 1.2 percent by weight of DDAMS. After cooling and crushing, the Banbury product was micronized in a Sturtevant mill and air classified to yield toner particles of a size of 12.5 microns in volume average diameter. The toner particles were then blended with 0.3 percent weight of AEROSIL R972®, 0.3 percent by weight of zinc stearate and 0.1 percent of BONTRON E-88® onto the surface of the toner in a Lodige blender.

EXAMPLE III

A magenta toner composition was prepared as follows: 94.75 percent by weight of styrene butadiene, 4.0 percent of the pigment, HOSTAPERM PINK EB™, a 2,9-dimethyl quinacridone, with a CI (color index) number of 73915, and a CAS (chemical abstract number) of 980-26-7, and 1.0 percent by weight of BONTRON E-88® or BONTRON E-84® and 0.25 percent by weight of cetyl pyridinium chloride (CPC) as a charge control agent to the toner were melt blended in the extruder, ZSK-53, wherein the die was maintained at a temperature of between 130° and 145° C., and the barrel temperature ranged from about 80° to about 100° C., followed by micronization in an AFG mill and air classification to yield toner particles of a size of 12.5 microns in volume average diameter. The toner particles were then blended with 0.3 percent by weight of AEROSIL R972® and 0.3 percent by weight of zinc stearate onto the surface of the toner in a Lodige blender. A magenta toner can also be prepared by repeating the aforementioned process with 2.5 percent of BONTRON E-88® and 0.25 percent of CPC as the charge control additives.

EXAMPLE IV

A magenta toner composition was prepared as follows: 95.0 percent by weight of styrene butadiene, 4.0 percent of the pigment, HOSTAPERM PINK EB ™, and 0.5 percent by weight of BONTRON E-88® or BONTRON E-84® and 0.5 percent by weight of DDAMS as a charge control agent to the toner were melt blended in an extruder, ZSK-53, wherein the die was maintained at a temperature of between 130° and 145° C., and the barrel temperature ranged from about 80° to about 100° C., followed by micronization in an AFG mill and air classification to yield toner particles of a size of 12.5 microns in volume average diameter. The toner particles were then blended with 0.3 percent by weight of AEROSIL R972® and 0.3 percent by weight of zinc stearate onto the surface of the toner in a Lodige blender.

EXAMPLE V

A magenta toner composition was prepared as follows: 95.5 percent by weight of styrene butadiene, 4.0 percent of the pigment, HOSTAPERM PINK EB™, 0.5 percent by weight of DDAMS as a charge control agent to the toner were melt blended in an extruder, ZSK-53, wherein the die was maintained at a temperature of between 130° and 145° C., and the barrel temperature ranged from about 80° to about 100° C., followed by micronization in an AFG mill and air classification to yield toner particles of a size of 12.5 microns in volume average diameter. The toner particles were then blended with 0.3 percent by weight of AEROSIL R972®, 0.3 percent by weight of zinc stearate, and 0.05 percent of BONTRON E-88® onto the surface of the toner in a Henscel blender.

EXAMPLE VI

A magenta toner composition was prepared as follows: 93.6 percent by weight of styrene butadiene, 6.0 percent of the pigment, SUNFAST MAGENTA™, that is 2,9-dimethyl quinacridone with a Cl number of 73915, and a CAS number of 980-26-7, and 0.4 percent by weight of DDAMS as a charge control agent to the toner were melt blended in an extruder, ZSK-53, wherein the die was maintained at a temperature of between 130° and 145° C., and the barrel temperature ranged from about 80° to about 100° C., followed by micronization in an AFG mill and air classification to yield toner particles of a size of 12.5 microns in volume average diameter. The toner particles were then blended with 0.3 percent by weight of AEROSIL R972®, 0.3 percent by weight of zinc stearate, and 0.1 percent by weight of BONTRON E-88® onto the surface of the toner in a Henschel blender.

EXAMPLE VII

A magenta toner composition was prepared as follows: 95.0 percent by weight of styrene butadiene, 4.0 percent of the pigment, high solids SUNFAST MAGENTA™, that is 2,9-dimethyl quinacridone with a Cl number of 73915, and a CAS number of 980-26-7, which pigment is in the form of a presscake comprised of 50 percent by weight of water and 50 percent by weight of pigment, and 1.0 percent by weight of DDAMS as a charge control agent to the toner were melt blended in an extruder, ZSK-53, wherein the die was maintained at a temperature of between 130° and 145° C., and the barrel temperature ranged from about 80° to about 100° C., followed by micronization in an AFG mill and air classification to yield toner particles of a size of 12.5 microns in volume average diameter. The toner particles were then blended with 0.3 percent by weight of AEROSIL R972®, 0.3 percent by weight of zinc stearate, and 0.1 percent by weight of BONTRON E-88® onto the surface of the toner in a Henschel blender.

EXAMPLE VIII

A magenta toner composition was prepared as follows: 95.85 percent by weight of styrene butadiene, 3.5 percent of the pigment, SUNFAST MAGENTA™, that is 2,9-dimethyl quinacridone with a Cl number of 73915, and a CAS number of 980-26-7, and 0.4 percent by weight of DDAMS and 0.25 percent by weight of cetyl pyridinium chloride (CPC) as a charge control agent to the toner were melt blended in an extruder, ZSK53, wherein the die was maintained at a temperature of between 130° and 145° C., and the barrel temperature ranged from about 80° to about 100° C., followed by micronization in an AFG mill and air classification to yield toner particles of a size of 12.5 microns in volume average diameter. The toner particles were then blended with 0.3 percent by weight of AEROSIL R972®, 0.3 percent by weight of zinc stearate, and 0.05 percent by weight of BONTRON E-88® onto the surface of the toner in a Lodige blender. The charging characteristics of this toner were too high. Consequently, image quality was poor and machine stability was a problem.

EXAMPLE IX

A deep dark red toner can be prepared as a blend of a magenta toner and a red toner. A red toner composition was prepared in an extrusion device, available as ZSK53 from Werner Pfleiderer, by adding to the device a first toner comprised of 92 percent by weight of suspension polymerized styrene butadiene copolymer resin particles (87/13), reference U.S. Pat. No. 4,558,108, the disclosure of which is totally incorporated herein by reference; 6.7 percent of LITHOL SCARLET™, 0.3 weight percent of the pigment HOSTAPERM PINK E™, and 1 percent by weight of the charge enhancing additive distearyl dimethyl ammonium methyl sulfate. The toner product, which was extruded at a rate of 300 pounds per hour, reached a melting temperature of 385° ±5° F. The extrudate was pelletized by a Mist-Water Grandulator (MWG) and the pellets subsequently cooled by immersing them in a water bath maintained at room temperature, about 25° C. Subsequent to air drying, the resulting toner was processed in a 800AFG grinder to produce toner particles with a volume median diameter of from 11 to 13 microns as measured by a Layson cell. Thereafter, the aforementioned toner particles were classified through two Donaldson Model B classifiers connected in series for the primary purpose of removing fine particles, that is those with a volume median diameter of less than 4 microns. There was then added to the toner surface 0.6 percent of AEROSIL R972® and 0.6 percent of zinc stearate by mixing the above prepared toner with the aforementioned two surface additives in a 75 liter Henschel blender operating at 1,500 rpm for 10 minutes. The above red toner was not passed through a turbo screener.

A second toner was prepared as in Example V. The grinding and classifying were the same as for the red composition above, however, the magenta toner was not blended with additives nor passed through a turbo screener.

The aforementioned second (magenta) and first (red) toners were then added to a 75 liter Henschel blender in a 50:50 ratio (15 pounds of red, and 15 pounds of magenta), and mixed for 5 minutes at 880 rpm, followed by an additional 10 minutes at 1,500 rpm, and there resulted a deep red toner, that is passed through a 37 micron turbo-screener to remove large particles. The deep red toner resulting possessed an excellent charge spectra as determined by the known charge spectrograph, thus for example, there was minimal wrong sign negative charge toner, and stable desirable triboelectric characteristics wherein the triboelectric charge of the deep red toner was 15 microcoulombs per gram as determined by the known Faraday Cage method. This toner was utilized in a Xerox Corporation 4850 and there resulted deep red images with excellent color intensity, and superior line and solid resolution.

EXAMPLE X

The process of Example IX was repeated except that the above prepared red classified toner and the SUNFAST MAGENTA™ screened toner were selected. Substantially similar results as reported above were obtained. In addition, red screened toner and magenta screened toner may be selected to achieve the same results. Finally, classified red toner and magenta classified toner can be blended with the appropriate additives to achieve similar results. All showed excellent copy quality and no charge separation during development.

EXAMPLE XI

The processes of Examples IX and X may be used to prepare additional colored toners. Ten to 90 percent of the above prepared red toner can be blended with 90 to 10 percent of the above prepared SUNFAST MAGENTA™ toner to provide a range of shades from an orange red through deep red to magenta. Ten to 90 percent of green (Heliogen) toner can be blended with 90 to 10 percent of the above prepared SUNFAST MAGENTA™ toner to provide shades from magenta, through mauve, gray, loden green to green. Ten to 90 percent of cyan or blue toner can be blended with 90 to 10 percent of magenta toner to provide a cyan through royal, violet or purple to magenta.

Other embodiments and modifications of the present invention may occur to those skilled in the art subsequent to a review of the information presented herein; these embodiments and modifications, as well as equivalents thereof, are also included within the scope of this invention.

What is claimed is:

1. An imaging process consisting essentially of (1) charging an imaging member in an imaging apparatus; (2) creating on the member a latent image comprising areas of high, intermediate, and low potential; (3) developing the low areas of potential with a first developer comprising carrier and a first negatively charged toner comprised of resin, the magenta pigment 2,9-dimethyl quinacridone, a charge additive, and surface additives; (4) developing the high areas of potential with a second developer comprising carrier and a second black toner comprised of resin, pigment, and a charge enhancing additive that enables a positively charged toner; (5) transferring the resulting developed image to a substrate; and (6) fixing the image thereto; and wherein said magenta pigment is present in an amount of about 3.5 weight percent, said resin is styrene butadiene, said charge additive for the negatively charge toner is distearyl dimethyl ammonium methylsulfate present in an amount of about 1.2 weight percent, and said surface additives are comprised of about 0.3 weight percent of zinc stearate, 0.3 weight percent of fumed silica, and 0.1 weight percent of the complex salt tris(3,5-di-tertiary-butylsalicylato) aluminum, and wherein the charge additive for the positively charged toner is cetyl pyridinium chloride.

2. A process in accordance with claim 1 wherein the resin is a styrene methacrylate, a styrene acrylate, or a styrene butadiene.

3. A process in accordance with claim 1 wherein the resin is styrene butadiene.

4. A process in accordance with claim 1 wherein the black toner pigment is carbon black.

5. A process in accordance with claim 1 wherein the carrier particles for the first and second developer are comprised of a core with a coating thereover, or a plurality of coatings thereover.

6. A process in accordance with claim 5 wherein the core is steel, iron powder, or a ferrite.

7. A process in accordance with claim 1 wherein the carrier particles for each developer contains a polymeric coating with conductive components therein.

8. A process in accordance with claim 1 wherein the toner for the first developer with magenta pigment possesses a triboelectric charge of from about −5 to about −25 microcoulombs per gram, and the toner for the second developer with black pigment possesses a triboelectric charge of from about +5 to about +25 microcoulombs per gram.

9. A process in accordance with claim 1 wherein the low and high areas of potential are developed by a conductive magnetic brush development system.

10. A process in accordance with claim 1 wherein the imaging member is comprised of a layered organic photoconductive member, or an organic photoreceptor.

11. A process in accordance with claim 1 wherein the high areas of potential are from about −750 to about −850 volts, the intermediate areas of potential are from about −350 to about −475 volts, and the low areas of potential are from about −95 to about −180 volts, or wherein the high areas of potential are from about −700 to about −850 volts, the intermediate areas of potential are from about −350 to about −500 volts, and the low areas of potential are from about −80 to about −180 volts.

12. A process in accordance with claim 1 wherein the areas, or levels of potential are separated by from about 100 to about 350 volts.

13. A process in accordance with claim 1 wherein the first and second carrier particles possess a conductivity of from about $10^{-14}$ to about $10^{-7}$(ohm-cm)$^{-1}$.

14. A process in accordance with claim 1 wherein the magenta toner is contained in a housing biased to from about −450 to about −550 volts, and the black developer is contained in a housing biased to from about −250 to about −350 volts, and wherein the transferred image is permanently affixed to the substrate by the application of heat and pressure.

15. A process in accordance with claim 1 wherein the carrier particles for the first and second developer have an average diameter of from about 50 to about 150 microns.

* * * * *